United States Patent [19]

Yates et al.

[11] 4,411,199

[45] Oct. 25, 1983

[54] BOOSTER FOR MISSILE FUZE WITH CYLINDRICAL WALL HOLES

[75] Inventors: Patrick A. Yates, China Lake, Calif.; Patrick M. McInnis, Garderville, Nev.

[73] Assignee: The United States of America as represented by the Secretary of the Navy, Washington, D.C.

[21] Appl. No.: 248,932

[22] Filed: Mar. 30, 1981

[51] Int. Cl.[3] ..... F42C 15/06

[52] U.S. Cl. ..... 102/481; 102/202.1; 102/380; 102/318; 102/275.4; 102/291

[58] Field of Search ..... 102/202, 202.1, 275.6, 102/379, 380, 481, 318, 275.4, 291

[56] References Cited

U.S. PATENT DOCUMENTS

| | | | |
|---|---|---|---|
| 2,995,088 | 8/1961 | Asplund | 102/318 X |
| 3,665,857 | 5/1972 | Radnich et al. | 102/1 R |
| 3,972,289 | 8/1976 | Morris | 102/70 R |
| 4,004,516 | 1/1977 | Johnson et al. | 102/24 R |
| 4,041,869 | 8/1977 | Miguel | 102/481 |
| 4,080,901 | 3/1978 | Heier et al. | 102/202 X |
| 4,270,455 | 6/1981 | Janoski | 102/318 |

*Primary Examiner*—Peter A. Nelson

*Attorney, Agent, or Firm*—R. F. Beers; W. Thom Skeer

[57] ABSTRACT

An improved booster construction having a metallic covering with a plurality of apertures therein encases a booster charge which, in turn, is encased in a nonmetallic cup having a low temperature melting characteristic permitting the booster charge to expand during thermal cook-off to prevent reaching critical temperature pressure relationships.

13 Claims, 3 Drawing Figures

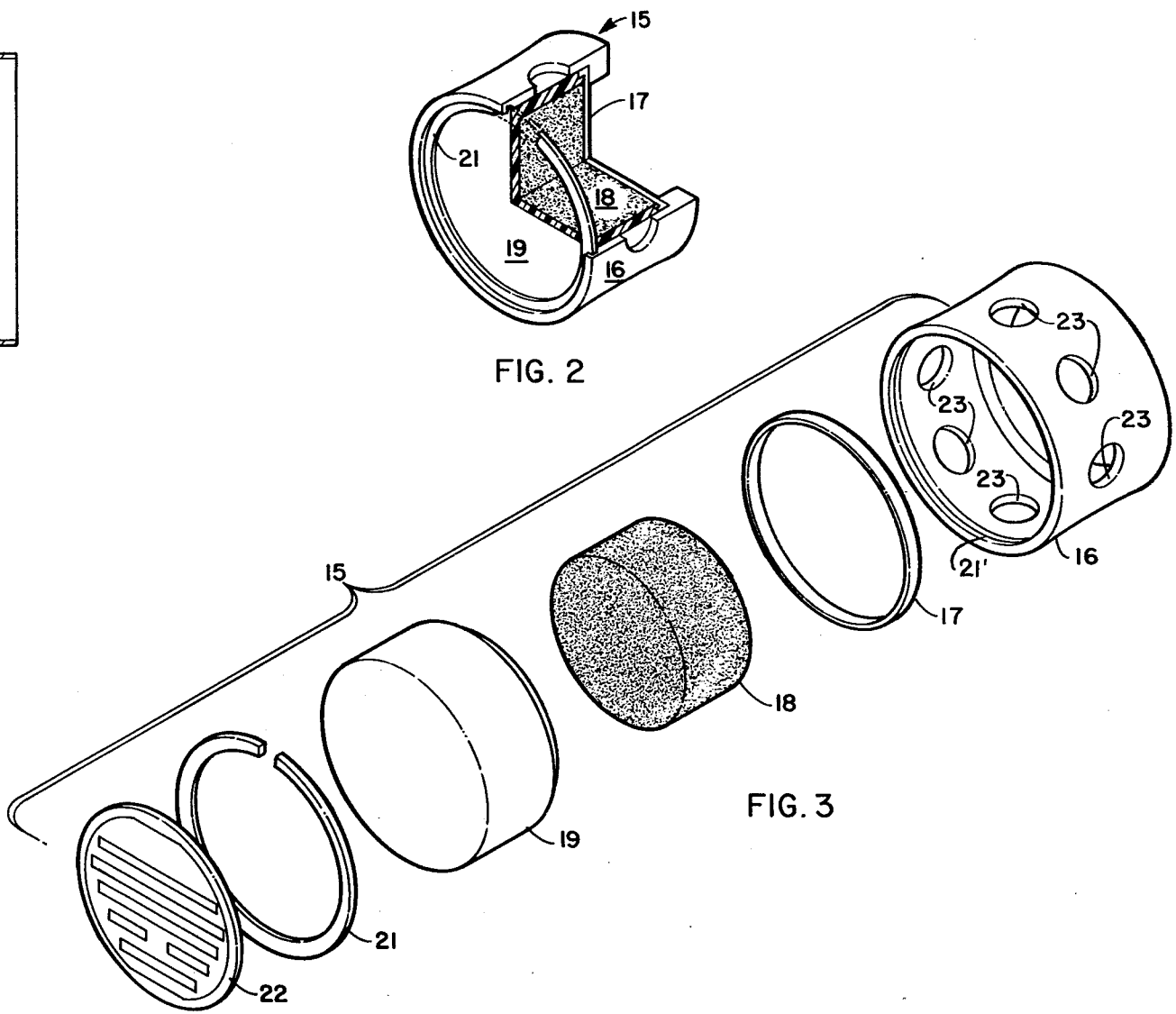
FIG. 3
FIG. 2
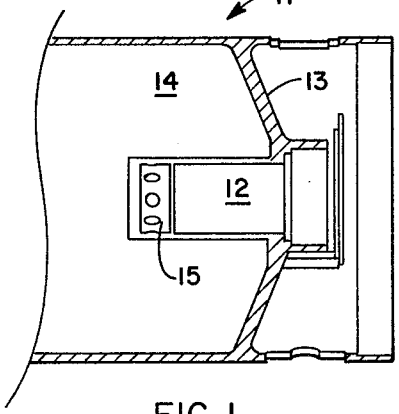
FIG. 1

BOOSTER FOR MISSILE FUZE WITH CYLINDRICAL WALL HOLES

BACKGROUND OF THE INVENTION

1. Field of the Invention:

This invention pertains to the field of ordnance construction. More particularly, the invention pertains to a booster configuration which has enhanced safety properties. By way of further characterization, the invention pertains to a booster and housing therefor which has a high mechanical strength while retaining a low thermal strength to permit venting during cook-off.

2. Description of the Prior Art:

Modern ordnance devices use chemical explosives for warheads which require a relatively high charge of explosive material to cause explosive ignition thereof. These chemicals are selected to minimize the explosive hazards caused by fire and other high temperatures such that the missiles may be stored in confined spaces without undue hazard to the housing structures and personnel nearby. Because of the nature of these chemicals a booster charge is ordinarily used with the fuze detonator to cause warhead explosion at the appropriate time. These booster materials pose certain safety hazards in missile carried ordnance. Such booster materials are prone to explosive detonation at temperatures which accompany the burning of the warhead material. In bombs and certain gun launched projectiles, a degree of safety is obtained by not assembling the booster into the warhead until shortly before the firing of the ordnance. However, in aerial missiles such a delayed assembly is impractical.

In such circumstances, the use of a low thermal stability plastic housing has been employed to relieve the pressure from the booster by having the housing melt prior to detonation temperatures and pressures being achieved. However, such arrangements have proven impractical in many applications. The nonmetallic container in most applications must be molded and fixed to be threadably attached to the conventional fuzing mechanism. Such an arrangement has not proven universally satisfactory. The plastic materials are subject to mechanical failure while being fitted to cause exposure of the booster charge to the elements or, when thickened to be mechanically strong to overcome such failures, have not melted reliably such that detonation occurs in some instances despite their presence.

SUMMARY OF THE INVENTION

The present invention employs a metallic housing surrounding the booster charge with the conventional metallic end plate to cooperate with the fuzing detonation device and a large area of thermally melting plastic which is relieved through apertures in a surrounding protective metallic housing. Thus the booster may be subjected to a higher degree of rough handling than its all plastic counterparts. Furthermore, the booster of the present invention may be easily assembled and disassembled to alter its type and renew its components as service may require.

Accordingly it is an object of the present invention to provide a improved booster assembly.

Another object of this invention is to provide a booster assembly for aerial missiles having improved safety characteristics.

Yet another object of this invention is to provide a booster which may be assembled from standard components to provide an ordnance device having high reliability.

These and other objects of the invention will become apparent from the following description, claims and drawings in which like parts are indicated with like numbers.

BRIEF DESCRIPTION OF THE DRAWINGS

FIG. 1 is a sectional view of a missile warhead showing the fuze and booster installed therein;

FIG. 2 is a view of the booster according to the invention in partial section; and FIG. 3 is an exploded view of the booster of the invention.

DESCRIPTION OF THE PREFERRED EMBODIMENT

Referring to FIG. 1, a missile indicated generally at 11 has a transverse bulkhead 13 which separates a warhead 14 from the guidance fuzing and propelling portions of the missile. Bulkhead 13 supports a fuze of conventional type having a detonator therein. As is conventional, a booster 15 is attached to fuze 12 to amplify the explosive powers or the detonator contained in fuze 12.

Referring to FIG. 2, the booster 15 is seen to comprise a sleeve 16 having an internally shouldered open end and an open end. The shouldered end supports a shallow metallic cup 17 into which a booster charge 18 is fitted. A nonmetallic cup 19 encloses the forward portion of booster charge 18 and is secured in sleeve 16 by means of a snap ring 21.

Snap ring 21 expands into and is held within a groove 21' cut in the internal face of the open end of sleeve 16 and extends into the opening thereof to provide an interference fit for cup 19 and thereby hold the assembled booster components into a unitary assembly.

Referring to FIG. 3, booster 15 and its disassembled component parts are illustrated. As shown, sleeve 16 has a plurality of apertures 23 which are large in comparison to the length of sleeve 16 such as to provide a maximum area for thermal expansion. An aperture diameter of 50–70% of the length of the sleeve has been used to good effect. A pellet of booster material 18 which may be, for example, an explosive known in the trade as CH-6 which is RDX-97.5%, calcium sterate-1.5%, graphite-0.5%, and polyisobutylene-0.5%. Explosive pellet 18 is enclosed within a deeper nonmetallic cup 19 which fits thereover. Cup 19 may be made of any suitable low melting plastic material, however, in developmental models of the invention, a polypropylene plastic which was glass and graphite filled proved satisfactory. Snap ring 21 is of conventional mechanical manufacture and need not be described in greater detail. A label 22 is adhesively secured to the end of cup 19 and is visible through the open end of sleeve 16 such that when booster cup 15 is installed on fuze 12, the type of booster element may be easily read by operating personnel. This labeling technique and assembly technique permit a variety of booster materials and cup materials to be assembled in accordance with the nature of warhead 14 and the detonation capabilities of fuze 12.

Sleeve 16 is made from a conventional metallic alloy such as aircraft aluminum, for example, and extends beyond the end of cup 19 slightly such that increased mechanical strength is provided while, at the same time, exposing a large area of cup 19 to the thermal environment of booster 15.

The foregoing description taken together with the appended claims constitute a disclosure such as to enable a person skilled in the ordnance assembly arts and having the benefit of the teachings contained therein to make and use the invention. Further, the structure herein described meets the aforestated objects of invention, and generally constitutes a meritorious advance in the art unobvious to such an artisan not having the benefit of these teachings.

We claim:

1. A booster for a missile warhead detonation system comprising:

a sleeve having cylindrical walls and a shouldered open end and an open end and a plurality of apertures extending through said cylindrical walls;

a metallic cup fitting within said sleeve to be sealingly supported by said shouldered open end;

a booster explosive charge fitting in and supported by said metallic cup in alignment with said plurality of apertures in said sleeve wall;

a nonmetallic cup fitted within said sleeve and in cooperative arrangement with said metallic cup enclosing said booster charge and dimensioned to extend in proximate alignment with the open end of said sleeve; and means connected to the open end of said sleeve for retaining said metallic cup, said booster charge, and said nonmetallic cup within said sleeve.

2. A booster according to claim 1 wherein said apertures have a diameter greater than half the length of said sleeve.

3. A booster according to claim 1 wherein said shouldered end of said sleeve is threaded to attach to a fuze mechanism.

4. A booster according to claim 2 wherein said shouldered end of said sleeve is threaded to attach to a fuze mechanism.

5. A booster according to claim 1 wherein said booster charge consists essentially of 97.5% RDX, 1.5% calcium sterate, 0.5% graphite, and 0.5% polyisobutylene.

6. A booster according to claim 4 wherein said booster charge consists essentially of 97.5% RDX, 1.5% calcium sterate, 0.5% graphite, and 0.5% polyisobutylene.

7. A booster according to claim 1 wherein said nonmetallic cup is made from a polypropylene plastic base material.

8. A booster according to claim 7 wherein said polypropylene plastic base material is glass and graphite filled.

9. A booster according to claim 6 wherein said nonmetallic cup is made from glass and graphite filled polypropylene plastic material and is dimensioned to extend over more than half the area of the aforesaid apertures in said cylindrical walls.

10. A booster according to claim 1 wherein said retaining means comprises:

a groove in said cylindrical wall extending circumferentially thereabout and opening into the interior of said sleeve; and a snap ring positioned to be retained in said groove and dimensioned to extend into said sleeve to prevent said nonmetallic cup from exiting said sleeve.

11. A booster according to claim 9 wherein said retaining means comprises:

a groove in said cylindrical wall extending circumferentially thereabout an opening into the interior of said sleeve; and a snap ring positioned to be retained in said groove and dimensioned to extend into said sleeve to prevent said nonmetallic cup from exiting said sleeve.

12. A booster according to claim 1 wherein said nonmetallic cup has a flat end visible through said open end of said sleeve; and a label affixed to said flat end adapted to carry inditia identifying characteristics of said booster.

13. A booster according to claim 11 wherein said nonmetallic cup has a flat end visible through said open end of said sleeve; and a label affixed to said flat end adapted to carry inditia identifying characteristics of said booster.

* * * * *